United States Patent [19]

Brim

[11] Patent Number: 4,834,381

[45] Date of Patent: May 30, 1989

[54] METHOD OF PLAYING A BOWLING GAME

[75] Inventor: Ted E. Brim, Grand Haven, Mich.

[73] Assignee: Brunswick Corporation, Skokie, Ill.

[21] Appl. No.: 118,241

[22] Filed: Nov. 9, 1987

[51] Int. Cl.[4] ..... A63D 3/00

[52] U.S. Cl. ..... 273/37

[58] Field of Search ..... 273/37, 54 C, 57 R, 273/54 D

[56] References Cited

U.S. PATENT DOCUMENTS

| | | | |
|---|---|---|---|
| 3,153,538 | 10/1964 | Rogers | 273/43 D |
| 3,212,780 | 10/1965 | Jewell | 273/54 C |
| 3,529,824 | 9/1970 | Walch | 273/54 R |
| 4,597,575 | 7/1986 | Kosof | 273/37 |

FOREIGN PATENT DOCUMENTS

| | | | |
|---|---|---|---|
| 809541 | 4/1969 | Canada | 273/54 C |

OTHER PUBLICATIONS

First Stage Market Test of Brunswick's New Bowling System—Final Report, Apr. 1986.

*Primary Examiner*—Anton O. Oechsle
*Attorney, Agent, or Firm*—Wood, Dalton, Phillips, Mason & Rowe

[57] ABSTRACT

A method of playing a bowling game which includes the steps of selecting a course of a predetermined sequence of differing pin setups defining a plurality of frames to be played by a player at his respective playing station. Each player is required to deliver at least one of a preselected maximum number of balls in each of the frames. The number of balls delivered by each player in each frame is counted, along with the number of each player's pins remaining at the end of the frame, to determine a score for each player for each frame. Each player's frame score is recorded as determined by the counting. Each player's frame scores are added to determine that player's total score for the game. The players' game scores are compared to determine the winner of the game.

13 Claims, 1 Drawing Sheet

| | NAME | 1 (10) | 2 (2) | 3 (4) | 4 (3) | 5 (7) | 6 (6) | 7 (5) | 8 (1) | 9 (2) | TOTAL |
|---|---|---|---|---|---|---|---|---|---|---|---|
| 1 | JONES | 3 0 | 1 0 | 4 0 | 2 0 | 4 0 | 5 0 | 1 0 | 6 5 | 2 0 | 28 |
| 2 | SMITH | 6 5 | 2 0 | 2 0 | 1 0 | 3 0 | 4 0 | 2 0 | 1 0 | 3 0 | 24 |
| 3 | | | | | | | | | | | |
| 4 | BROWN | 3 0 | 4 0 | 8 4 | | | | | | | |
| 5 | GREEN | 6 5 | 8 2 | 10 2 | | | | | | | |
| 6 | | | | | | | | | | | |

METHOD OF PLAYING A BOWLING GAME

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by the players in turn. For many recreational or ordinary players, it is difficult to learn and understand the play of the game. This is because, in part, conventional bowling games require a strike or a spare to add a pin count for pins knocked down in subsequent frames to the pin counts in earlier frames. Quite often, running scores near the end of a game are not entered until the very last ball of a player is delivered. This cumbersome and difficult method of playing a conventional bowling game often leads to frustration and lack of interest to everyone but the skilled player. It is not uncommon for players to simply roll balls at pins and leave the scoring to others and never completely understand the rules of play. This leads to a lack of real interest and ultimately to players giving up on the sport.

In addition, conventional methods of playing bowling games often do not give a true indication of a player's skill. Leads shift back and forth during a game depending solely on sequences of strikes and spares, particularly near the end of a game. One player can build up such an early lead, again depending on his play timing, that other players lose hope and interest, and the level of play is greatly diminished.

There is a definite need for new methods of playing a bowling game which are easier to understand and learn and, accordingly, to play; for games which are more exciting during the entire play of the game; for games which are challenging but not difficult; and for games to increase and enhance the public interest in the sport. This invention is directed to satisfying these needs and to rectifying probems inherent in the conventional method of playing a bowling game.

SUMMARY OF THE INVENTION

Accordingly, an object of this invention is to provide a new method of playing a bowling game.

Another object of the invention is to provide a new method of playing a bowling game which incorporates some of the scheme of play incorporated in playing the game of golf.

More particularly, the method contemplates players being allowed a preselected maximum number of balls to knock down all pins in each of a preselected plurality of frames. The players may select a course comprising different numbers of frames, such as 9 or 18, such as the 9 or 18 holes in the game of golf. Each selected course includes a predetermined sequence of differing pin setups defining the plurality of frames (or "holes") to be played by a player at his respective playing station. Par values may be assigned to each frame or "hole", preferably commensurate to the difficulty of the respective pin setups.

Each player is required to deliver at least one of the preselected maximum number of balls (e.g. five) in each of the differing frames. The number of balls delivered by each player in each frame is counted, along with the number of each player's pins remaining at the end of the frame, to determine a score for each player for each frame. Each player's frame score which is determined by such counting is recorded as the game progresses with the players playing in turn.

At the end of each game, each player's frame scores are added to determine the player's total score for the game. The players' game scores then are compared to determine the winner of the game.

When par values are assigned for each pin setup, such as commensurate to the difficulty of the respective setup, the players' frame scores are subtracted from the par values of the respective frames to arrive at plus or minus numerical values defining scores above or below par.

Other objects, features and advantages of the invention will be apparent from the following detailed description taken in connection with the accompanying drawing.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawing, in which:

DETAILED DESCRIPTION OF THE PREFERRED EMBODIMENT

Figures 1, 2:
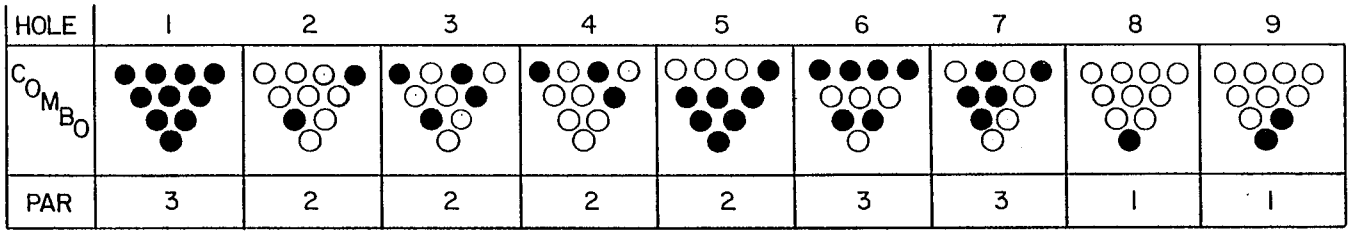
FIG. 1 is an illustration of a plurality of differing pin setups defining a course for playing the bowling game of this invention.
FIG. 2 is a conventional score sheet which might be used in playing the bowling game of this invention.

Briefly, in accordance with the invention, a method of playing a bowling game is contemplated wherein the bowling frames include predetermined differing pin setups of varying difficulty. The various pin setups may include a full rack of pins similar to the ten-pin setup at the beginning of a conventional bowling game, or differing pin setups which might be encountered as "leaves" in a conventional bowling game. However, some of the scheme of playing the game of golf is incorporated in the method of this invention by providing a course or a plurality of courses of a predetermined sequence of differing pin setups defining the plurality of frames or "holes" on the course. For instance, a player may select a 9-hole course (comprising nine frames) or an 18-hole course (comprising eighteen frames). As stated, each course includes a predetermined sequence of differing pin setups of varying difficulty.

Once a course is selected by the player or players of the game, each player is required, in turn, to deliver at least one ball in each frame in an attempt to knock down all pins in the respective frame. The invention contemplates a method in which a maximum predetermined number of balls (e.g. five) are allowed by each player for delivering during any given frame or hole.

After each player's turn, the number of balls delivered by that player in that frame is counted, along with the number of pins left by that player or remaining standing at the end of the given frame. For instance, if a given frame or "hole" has a pin setup of five pins, and a player knocks down all five pins with one ball, his score for that frame or hole wound be "1". If the player knocked down all five pins with three delivered balls, his score would be "3". If the player delivered all five balls and left two pins standing, his score would be "7". It immediately can be seen that the scoring step in the method of playing the bowling game of this invention is quite simple and understandable by even a novice. This simplification, taken in conjunction with the differing challenges afforded by the differing pin setups, greatly enhances the value of the game.

After counting each player's frame score, that frame score is recorded on an appropriate score sheet, as described hereinafter. After the selected course is completed by all of the players, each player's frame scores are added to determine the player's total score for the game. The players' game scores then are compared to determine the winner of the game.

Referring to the drawings, a game has been set up by a twosome of "Jones" and "Smith" who, as can be seen in FIG. 1, have selected a nine "hole" or frame course. They also might have selected an eighteen-hole course or any other number of frames. Each hole or frame has been numbered sequentially, with the number of pins in each frame in parenthesis alongside the respective frame number on the score sheet of FIG. 2. For instance, it can be seen that the selected course has ten pins in hole or frame "1", two pins in frame "2", four pins in frame "3", three pins in frame "4", seven pins in frame "5" and so on through each frame of the respective course. It immediately can be seen that practically an infinite number of courses could be designed. This is particularly true since a pin setup of only two pins itself can be different from another pin setup of two pins. For instance, as shown, frame "2" and frame "9" both have a two-pin setup. However, these two pin setups can be different in any given course and, of course, should be of varying difficulty.

Although the method of playing the bowling game of this invention could require each player to deliver only one ball at each pin setup, it is desirable to allow each player a maximum predetermined number of balls to be delivered in each turn or frame. For purposes of illustration, it will be assumed that each player is allowed to deliver a maximum number of five balls during each frame or "hole" in an attempt to knockdown all pins in that frame. With that assumption, and with the course selected as described above, a simulated game and corresponding scoring will be described.

Specifically, Jones takes his turn at frame or hole "1" has the aforesaid pin setup of a full rack of ten pins. Jones delivers three balls and knocks down all 10 pins. It can be seen on the score sheet that the corresponding numbers "3" and "0" have been entered. Jones' score for that frame or hole would be "3", as indicated. Smith, on the other hand, has a bad "hole" and delivers all five of his balls and still leaves one pin standing. His score for that hole is "6".

During the next frame or hole "2", a two-pin setup is encountered. Jones knocks down both pins with one ball and achieves a score for that hole of "1". Smith required two balls to knock down both pins, resulting in a score of "2".

In frame or hole "3", Jones requires four balls to knock down the four pins of that particular pin setup. Smith recovers and knocks down all four pins with only two balls. It can be seen that Jones' and Smith's corresponding scores are "4" and "2", respectively. This play procedure is continued throughout the game until each player has taken his turn at each of the nine frames or holes. The frame scores of the respective players then are added to determine each player's total game score which is recorded in the right-hand column of the Figure. It can be seen that Jones has a total game score of 28, and Smith has a total game score of 24. Since Smith has required fewer balls to be delivered and has left fewer pins standing at the ends of the frames or holes throughout the game, Smith has won the game with a lesser point total. Of course, the frame scores can be added in a running fashion as shown by players "Brown" and "Green" who are shown with the same scores as Jones and Smith through the first three frames.

An alternative method of scoring the bowling game of this invention would be to assign par values to each of the differing pin setups in each of the selectable courses. Preferably, the par values would be made commensurate to the difficulty of the respective pin setups. This would give an additional simulation to the game in comparison to the game of golf. For instance, referring back to FIG. 1, frame or hole "1" may have a par value of three. Jones' score for that frame then would be "0" since he required three balls to knock down all ten pins. Since Smith used all five balls, he would have a plus-two score, with a penalty of "1" added for the one pin left standing, for a total frame or hole score of "+3".

Using the par value scoring system for frame or hole "2" in the Figure, it will be assumed that this two-pin setup is quite difficult, with a par assigned of two balls. It can be seen that Jones knocked down both pins with one ball and would be given a score of "−1". Smith achieved par by knocking down the two pins with two balls, resulting in a par score of "0". Again, the player with the lesser numerical game total score would win the game, but the scoring system would more simulate the game of golf.

Although the method of this invention for playing a bowling game involves sequences of differing pin setups which can be selected manually, it is readily apparent that the game can be rapidly played with modern-day pin spotting machines which can be programmed to sequentially leave any predetermined sequence of differing pin setups to define a selected course of play. The pin setups can be predetermined for a full predetermined course, or they can be randomly selected either by the players or by a computer system.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of playing a bowling game in which players are allowed a preselecting maximum number of balls to knock down all pins in each of a preselected plurality of frames, said method comprising:

(a) selecting a course of a predetermined sequence of differing pin setups defining said plurality of frames to be played by a player at his respective playing station;

(b) requiring each player to deliver at least one of said preselected maximum number of balls in each of said frames;

(c) counting the number of balls delivered by each player in each frame and the number of each player's pins remaining at the end of said frame, to determine a score for each player for each frame;

(d) recording each player's frame score determined by said counting;

(e) adding each player's frame scores to determine said player's total score for the game; and (f) comparing the players' game scores to determine the winner of the game.

2. The method of claim 1, including the step of assigning a par value to each of said differing pin setups, and comparing each player's frame score with the par value of the respective frame.

3. The method of claim 2 wherein said par values are made commensurate to the difficulty of the respective pin setups.

4. The method of claim 2 wherein each player's frame scores are subtracted from the par value for the pin setup of the respective frames to arrive at plus or minus numerical values defining said scores.

5. The method of claim 1 wherein said course is selected from a preselected number of courses each of differing numbers of differing pin setups.

6. A method of playing a bowling game in which players are allowed a number of balls to knock down all pins in each of a preselected plurality of frames, said method comprising:

(a) selecting a course of a predetermined sequence of differing pin setups defining said plurality of frames to be played by a player at his respective playing station;

(b) requiring each player to deliver at least one ball in each of said frames;

(c) counting the number of balls delivered by each player in each frame and the number of each player's pins remaining at the end of said frame, to determine a score for each player for each frame;

(d) recording each player's frame score determined by said counting;

(e) adding each player's frame scores to determine said player's total score for the game; and (f) comparing the players' game scores to determine the winner of the game.

7. The method of claim 6, including the step of assigning a par value to each of said differing pin setups, and comparing each player's frame score with the par value of the respective frame.

8. The method of claim 7 wherein said par values are made commensurate to the difficulty of the respective pin setups.

9. The method of claim 7 wherein each player's frame scores are subtracted from the par value for the pin setup of the respective frames to arrive at plus or minus numerical values defining said scores.

10. The method of claim 6 wherein said course is selected from a preselected number of courses each of differing numbers of differing pin setups.

11. A method of playing a bowling game in which players are allowed a preselected maximum number of balls to knock down all pins in each of a preselected plurality of frames, said method comprising:

(a) selecting a course from a preselected number of courses each having a different predetermined sequence of differing pin setups defining said plurality of frames for each course to be played by a player at his respective playing station;

(b) assigning a par value to each of said differing pin setups in the selected course;

(c) requiring each player to deliver at least one of said preselected maximum number of balls in each of said frames;

(d) counting the number of balls delivered by each player in each frame and the number of each player's pins remaining at the end of said frame, to determine a score for each player for each frame;

(e) comparing each player's frame score with the par value of the respective frame;

(f) recording each player's over-or-under par scores to determine said player's total par score for the game; and (g) comparing the players' game scores to determine the winner of the game.

12. The method of claim 11 wherein said par values are made commensurate to the difficulty of the respective pin setups.

13. The method of claim 11 wherein each player's frame scores are subtracted from the par value for the pin setup of the respective frames to arrive at plus or minus numerical values defining said scores.

* * * * *